US006899665B2

(12) United States Patent
Driggers

(10) Patent No.: US 6,899,665 B2
(45) Date of Patent: May 31, 2005

(54) MEDIA FOLDING

(75) Inventor: Matt G. Driggers, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 33 days.

(21) Appl. No.: 10/131,314

(22) Filed: Apr. 23, 2002

(65) Prior Publication Data

US 2003/0199377 A1 Oct. 23, 2003

(51) Int. Cl.[7] ..... B31F 7/00

(52) U.S. Cl. ..... 493/420; 493/419; 493/416; 270/68 R; 270/39.05; 271/19

(58) Field of Search ..... 493/419, 420, 493/416, 421, 442, 454; 270/68 R, 39.05; 271/19

(56) References Cited

U.S. PATENT DOCUMENTS

| | | | | |
|---|---|---|---|---|
| 1,734,742 | A | * 11/1929 | Novick | 493/422 |
| 3,698,705 | A | * 10/1972 | Funk et al. | 493/19 |
| 3,975,009 | A | * 8/1976 | Brown | 493/14 |
| 4,179,111 | A | * 12/1979 | Gunther et al. | 493/216 |
| 4,985,013 | A | * 1/1991 | van der Werff et al. | 493/444 |
| 5,049,227 | A | 9/1991 | Long et al. | |
| 5,108,082 | A | 4/1992 | Shea et al. | |
| 5,263,708 | A | * 11/1993 | Hacknauer | 271/303 |
| 5,377,965 | A | 1/1995 | Mandel et al. | |
| 5,391,138 | A | 2/1995 | Abramson et al. | |
| 5,437,596 | A | 8/1995 | Bogdan et al. | |
| 5,437,597 | A | 8/1995 | Boughton et al. | |
| 5,871,433 | A | 2/1999 | Lehmann et al. | |
| 6,004,254 | A | 12/1999 | Murata | |
| D431,046 | S | 9/2000 | Dwyer et al. | |
| 6,167,231 | A | 12/2000 | Blackman et al. | |
| 6,293,716 | B1 | 9/2001 | Driggers et al. | |
| 6,332,068 | B2 | 12/2001 | Blackman et al. | |

FOREIGN PATENT DOCUMENTS

| | | |
|---|---|---|
| EP | 1000894 | 5/2001 |
| GB | 2178412 | 2/1987 |
| GB | 2209738 | 5/1989 |
| JP | 62196247 | 8/1987 |
| JP | 63-310453 | 12/1988 |
| JP | 10-117174 | 5/1989 |
| JP | 9-67062 | 3/1997 |
| JP | 10-236721 | 9/1998 |
| JP | 2001-2317 | 1/2001 |
| JP | 2001-34123 | 2/2001 |

* cited by examiner

*Primary Examiner*—Eugene Kim
*Assistant Examiner*—Christopher Harmon

(57) ABSTRACT

A folding mechanism couples to a printing mechanism and receives media for folding therein.

26 Claims, 12 Drawing Sheets

MEDIA FOLDING

BACKGROUND

Application of print imaging to media and subsequent folding of media often occur when preparing printed material. In some cases media bearing print imaging are folded for packaging. In other cases, media are folded to form a display unit. Frequently, media are folded to fit into, for example, envelopes for mailing purposes. Sometimes, media suitably folded and attached in such form may be used as a mailable item without an envelope. Application of print imaging occurs in many cases by a separate printing system and at a different time relative to a subsequent folding operation. For example, an inventory of printed material can be first generated and thereafter applied as a batch to a separate folding operation for final processing.

A common and widely familiar operation including application of print imaging and subsequent folding includes preparation of correspondence or other documents in, for example, homes and offices, and folding of such correspondence and documents for insertion into envelopes. In other common operations, media suitably folded, e.g., in thirds or in half, for example, are mailed without use of an envelope. For example, standard-sized media folded twice, e.g., into thirds, and attached together by tape or staple in such configuration are suitable for presentation as a mailable article. While it would be of great convenience to automate such folding, most homes and offices cannot justify a folding machine for routine preparation of correspondence and associated documents for mailing. Such mailing operations can use an expensive folding machine, but only when justified by large scale projects. In many situations, labor-intensive effort must be expended in the folding step.

Generally, folding machines are elaborate, expensive, high volume and massive industrial machines not particularly useful for other than large-scale folding operations, e.g., not well adapted for home or office use. Folding devices are sometimes owned by printing and copying services or by large bulk-mailing companies. Inexpensive folding machines are generally not available to most home or office printer users. Folding resources, therefore, are generally available by contracting with printing and copying services or with bulk-mailing companies.

SUMMARY OF THE INVENTION

A folding mechanism couples to a printing mechanism and receives media for folding therein.

The subject matter of the present invention is claimed in the concluding portion of this specification. The organization and method of operation of a particular embodiment or embodiments may best be understood by reference to the following description taken with the accompanying drawing.

BRIEF DESCRIPTION OF THE DRAWINGS

For a better understanding of one or more illustrated embodiments, and to show how the same may be carried into effect, reference will now be made, by way of example, to the accompanying drawings in which.

DETAILED DESCRIPTION OF THE PREFERRED EMBODIMENT

The following disclosure illustrates media folding by a variety of folding modules and in some embodiments as combined with a printing mechanism. Folding modules as illustrated herein may be constructed and operated at low cost to provide a reasonable alternative to home and office users wishing to take advantage of automated folding in conjunction with preparation of printed material. By feeding media from the printing mechanism into automated folding modules, one accomplishes both application of print imaging and folding of media in a single integrated operation. With a combined printing and folding system, users enjoy the advantage of automated folding in conjunction with preparation of printed material, but do not suffer the expense of industrial-scale folding operations. Folding modules may be selectably coupled in various combinations and selectively activated to perform a variety of folding operations.

Figure 1:
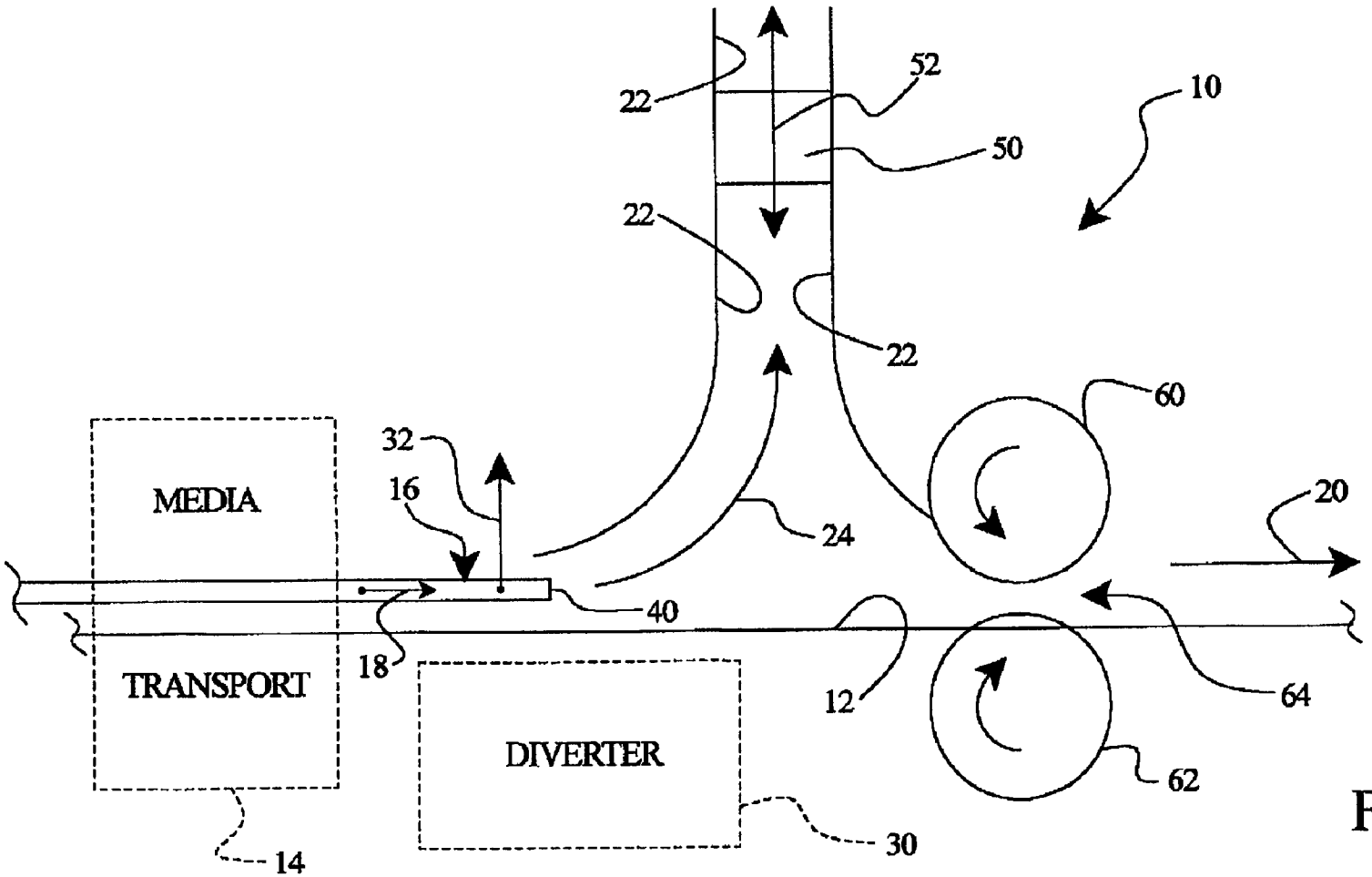
FIGS. 1–4 illustrate a media folding operation.

FIGS. 1–4 illustrate schematically a folding operation 10. In FIG. 1, folding operation 10 makes use of a support platform 12 and a media transport 14 propelling media 16 by application of force 18 along a feed direction 20. As will be discussed more fully hereafter, according to one embodiment illustrated herein, media transport 14 may be provided by a printing mechanism applying print imaging to, for example, sheet-form media 16 and submitting automatically media 16 to folding operation 10. A diversion path 22 deviates from feed direction 20 beginning along a diversion direction 24. A diverter 30 selectively applies diversion force 32 to media 16 beginning at the mouth of diversion path 22 and thereby selectively diverts media 16. More specifically, diverter 30 sends leading edge 40 of media 16 onto diversion path 22. Diverter 30 may be taken as "active" when diverting media 16 onto diversion path 22 and "inactive" when allowing media 16 to pass thereby along feed direction 20. When active, diverter 30 sends leading edge 40 onto and along diversion path 22. When not active, diverter 30 allows media 16 past without disruption of motion along feed direction 20. As discussed more fully hereafter, diverter 30 may be constructed and operated in such fashion to serve as a support, e.g., in place of platform 12, for media 16 during folding operation 10.

A selectively positionable stop 50 blocks movement of media 16 along diversion path 22. More particularly, stop 50 is selectively positionable along diversion path 22 as indicated generally at reference numeral 52. Such positioning sets the travel distance of leading edge 40 along path 22.

Downstream from diversion path 22, e.g., along the feed direction 20, a pair of folding rollers 60 and 62 provide a nip 64 therebetween. Rollers 60 and 62 rotate in opposite directions and thereby propel media 16 when engaged at nip 64 along feed direction 20. As will be discussed more fully hereafter, the distance separating stop 50 and nip 64 affects the length of media 16 folded back, e.g., against feed direction 20, when diverter 30 is active.

Figure 2:
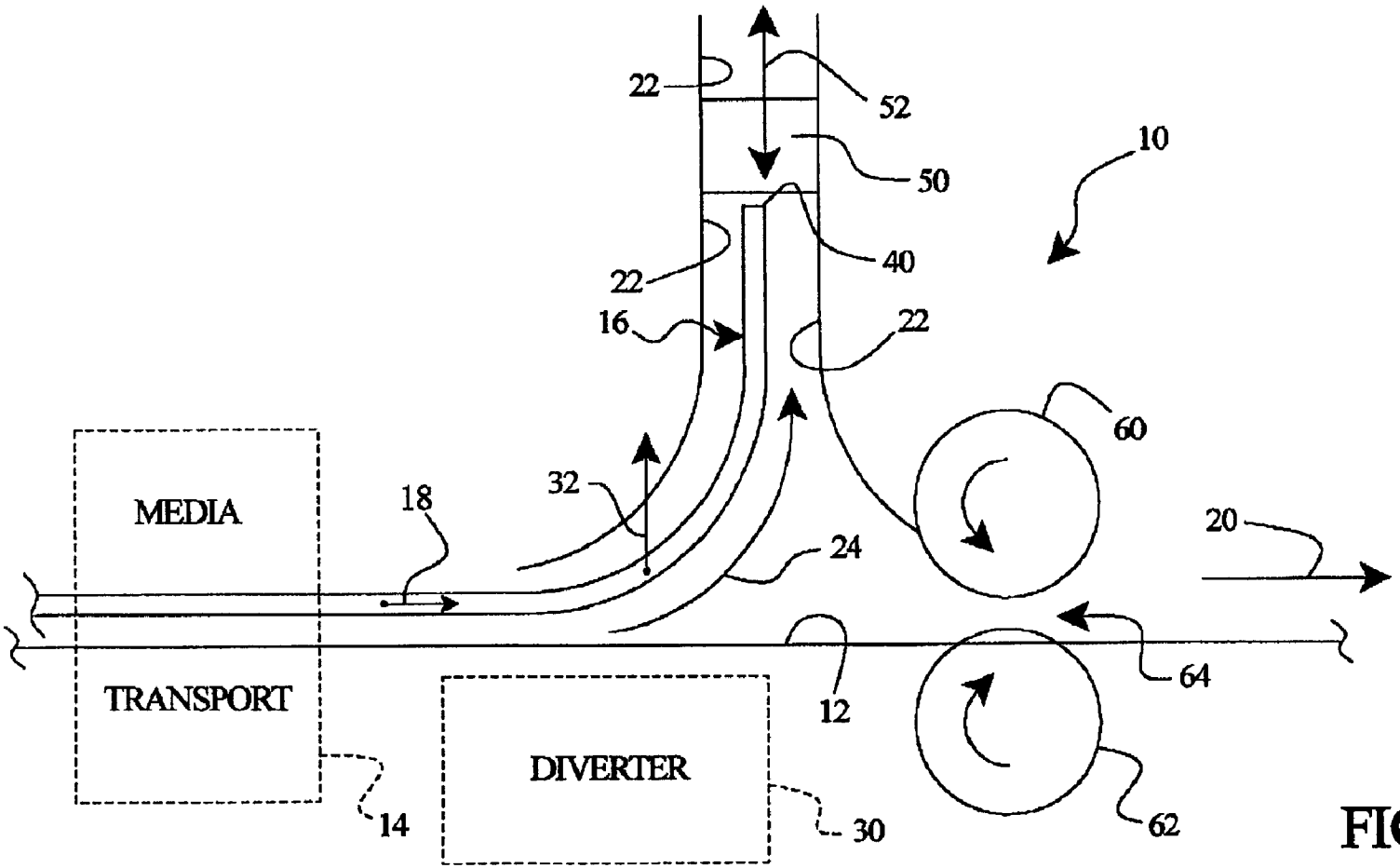

FIG. 2 illustrates media 16 as it approaches stop 50. Leading edge 40 travels along diversion path 22 sufficient distance to reach stop 50. During such time, a leading portion of media 16 travels along the diversion direction 24 by means of diverter 30 maintaining force 32 relative to media 16. As seen in FIG. 2, media 16 assume a generally "bowed" condition. More particularly, media 16 generally bends outward in the feed direction 20. When diverter 30 becomes inactive with media 16 therein, trailing portions of media 16 pass diverter 30 and continue in the feed direction 20 without experiencing diversion force 32 and without traveling in the diversion direction 24.

When one of media 16 is to be folded, diverter 30 sends its leading edge 40 onto diversion path 22 in the diversion direction 24 as illustrated in FIG. 2. As media transport 14 maintains force 18 against one of media 16, leading edge 40 eventually reaches stop 50. During such movement toward stop 50, leading portions follow leading edge 40 onto diversion path 22. In this regard, media transport 14 is sufficiently close to stop 50 along diversion path 22 to continue application of force 18 against media 16 to bring edge 40 at least against stop 50.

Figure 3:
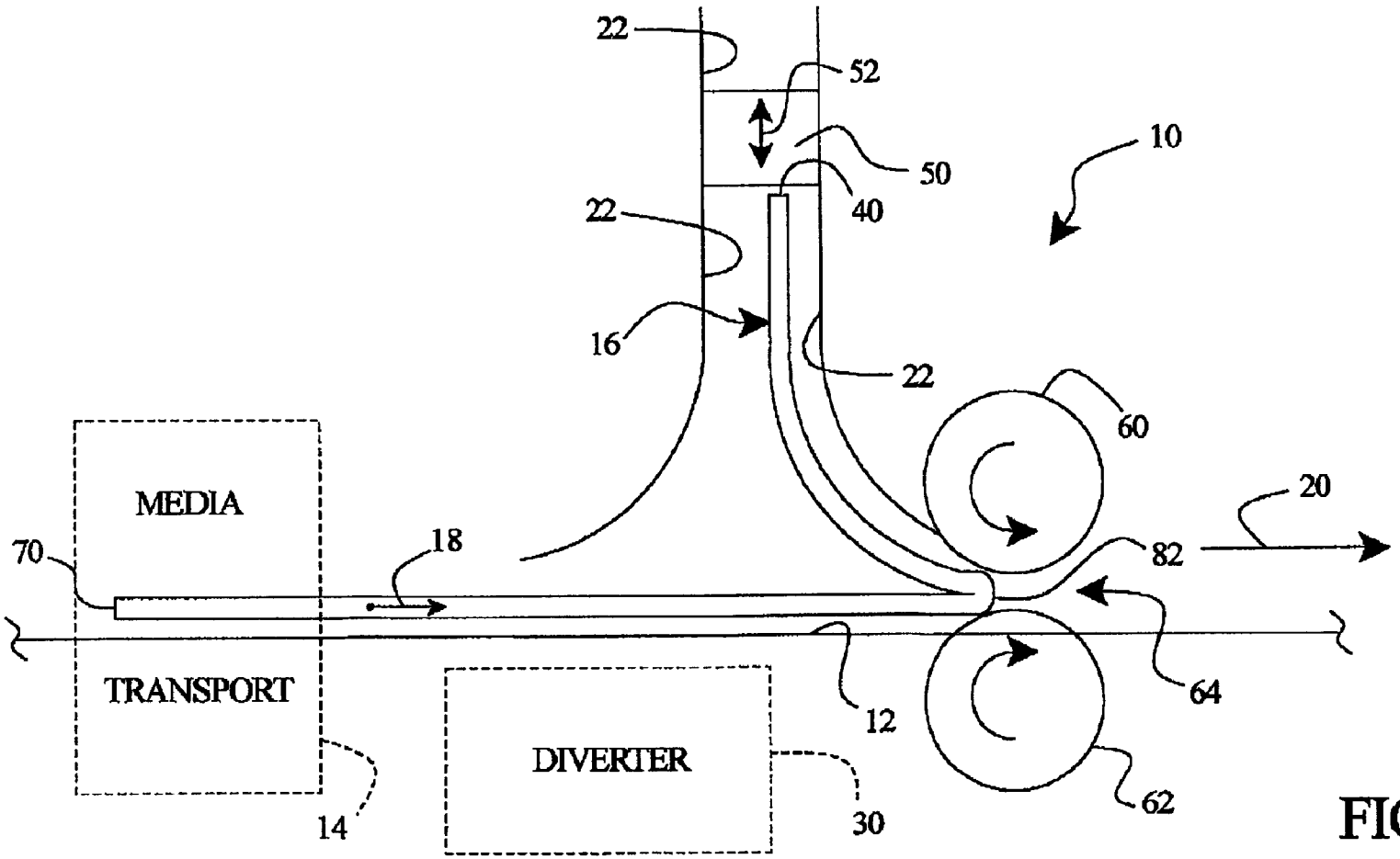

When leading edge 40 engages stop 50, diverter 30 assumes its inactive position. This allows trailing portions to pass by diversion path 22. In other words, diverter 30 as active first drives a leading portion, including leading edge 40, onto diversion path 22 and thereafter as inactive allows trailing portions to pass by diversion path 22 and continue in feed direction 20. Continued application of force 18 by media transport 14, as shown in FIG. 3, urges forward and in the feed direction 20 the trailing portions, e.g., trailing edge 70, of media 16. With diverter 30 inactive, however, media 16 further bends in the vicinity of the mouth of diversion path 22 to form a buckle moving on in feed direction 20. As media 16 continues forward, the buckle becomes more acute and eventually reaches nip 64. As rollers 60 and 62 engage and collect media 16, media 16 creases as it approaches nip 64 and folds as it passes through nip 64. A fold 82 results. Hereforward, fold 82 leads in the feed direction 20.

Figure 4:
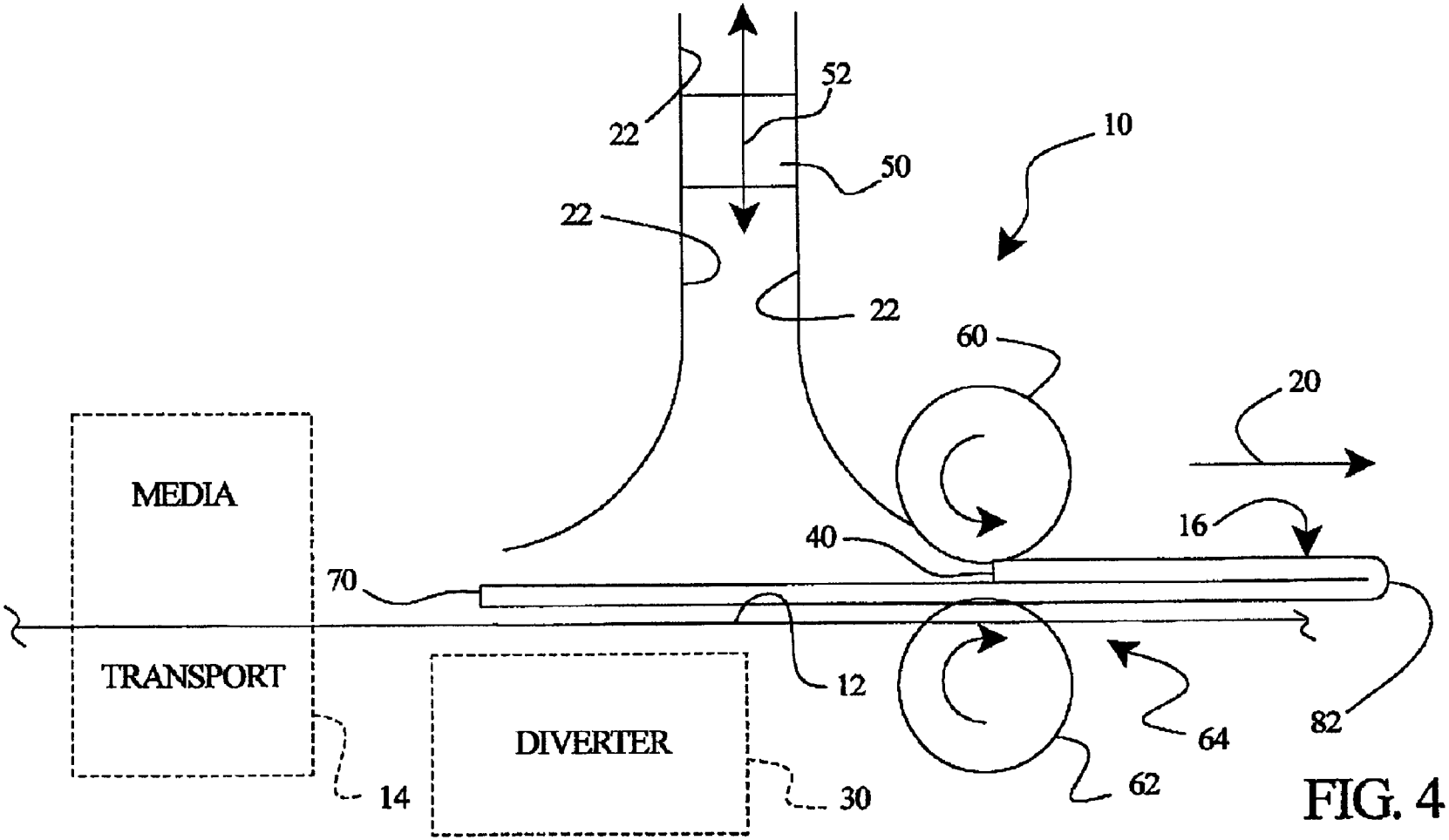

The relative spacing between media transport 14 and nip 64 can be located in relation to the distance between fold 82 and trailing edge 70 of media 16. Media transport 14 can be sufficiently close to nip 64 in relation to the size of media 16 to pass media transport responsibility from media transport 14 to nip 64 for continued movement of media 16 along feed direction 20. In this manner, media transport responsibility passes from media transport 14 to nip 64 to maintain the now folded media 16 in motion along feed direction 20. Media 16 then continues, as shown in FIG. 4, in folded condition, in the feed direction 20 after passing nip 64.

The relative proportion of media 16 on each side of fold 82 can be manipulated by selectively locating stop 50 along diversion path 22. The distance along path 22 and between nip 64 and stop 50, for example, can set the length of media 16 folded over and left between leading edge 40 and fold 82. By selecting such distance to be, for example, fifty percent (50%) of the length of media 16, e.g., a length as measured between leading edge 40 and trailing edge 70 when media 16 is in a planar condition, folding operation 10 folds media 16 "in half." Other selectable locations for stop 50, however, may fold media 16 at other corresponding selected relative proportions. For example, by suitably positioning stop 50 relative to nip 64 in relation to the overall length, e.g., a distance between leading edge 40 and trailing edge 70, one third of media 16 may be folded over as the "folded portion" of media 16 between leading edge 40 and fold 82. As will be discussed more fully hereafter, a second folding operation 10 with similar configuration and operating in series completes a "tri-fold" folding operation 10 relative to media 16. In other words, folding operations may be executed in series against a given one of media 16 and thereby complete multiple folds on a given one of media 16.

Figure 5:
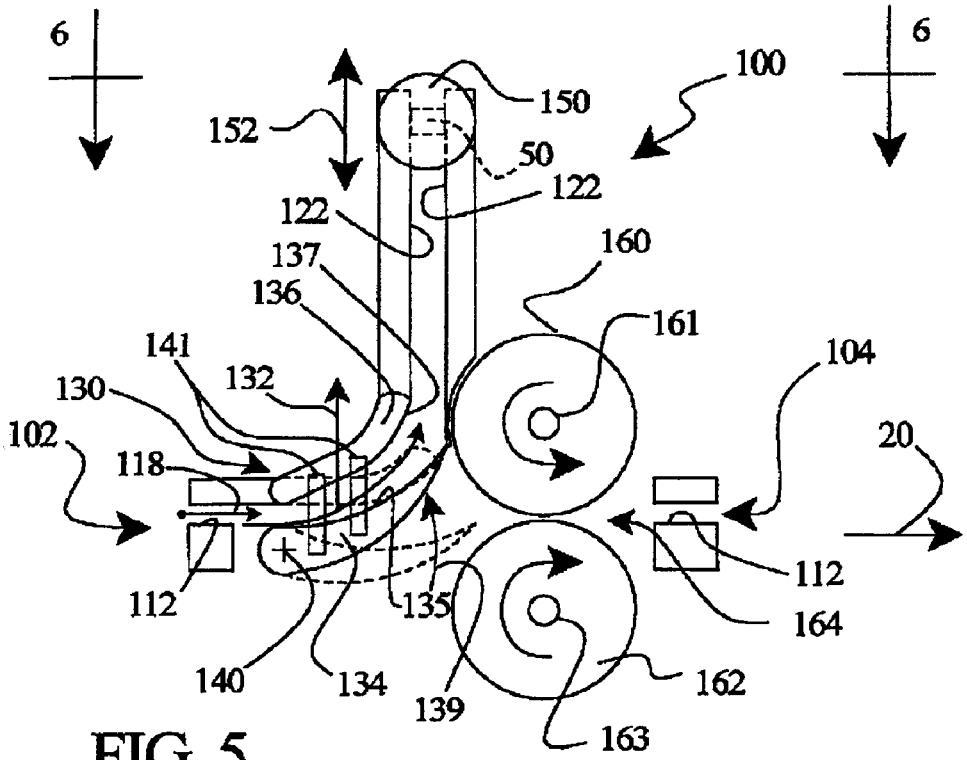
FIG. 5 is side elevational view of a media folding module performing the media folding operation FIGS. 1–4.
Figure 6:
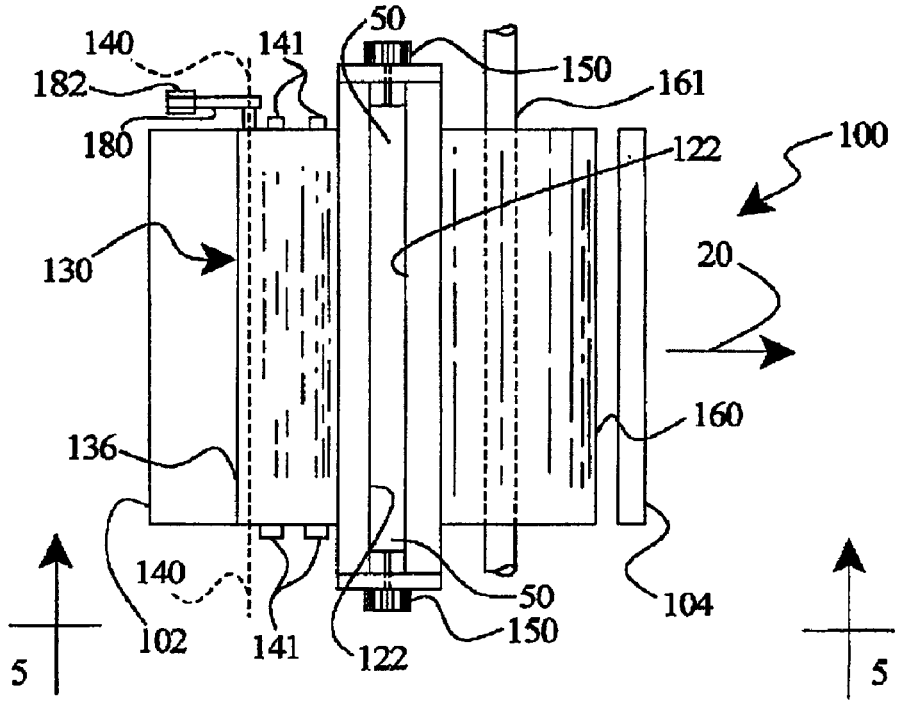
FIG. 6 is a top view of the media folding module of FIG. 5 as taken along lines 6—6 of FIG. 5.

FIGS. 5 and 6 illustrate a folding module 100 capable of performing the folding operation 10 of FIGS. 1–4. FIG. 5 illustrates module 100 in side view and FIG. 6 in top view. In FIGS. 5 and 6, module 100 includes a support 112 at its inlet 102 and outlet 104. Support 112 carries, e.g., in this embodiment vertically supports, media 16 at inlet 102 and at a module outlet 104. As discussed more fully hereafter, media 16 support intermediate inlet 102 and outlet 104 can be accomplished by other components of module 100.

A diverter 130 moves between an active position as illustrated in FIG. 5 and an inactive position as illustrated in phantom in FIG. 5. when in its active position, diverter 130 applies diversion force 132 to media 16 thereby propelling media 16 onto diversion path 122. When inactive, diverter 130 maintains media 16 translation in the feed direction 20 and provides support for media 16 when passing through the mid-portion of module 100. Diverter 130 includes a lower flap 134 and an upper flap 136. Together, flaps 134 and 136 form a "media nozzle" selectively directing media 16 either onto diversion path 122 or along feed direction 20. Lower flap 134 presents a generally curved and upwardly inclined surface 135 providing smooth transition from inlet 102 onto diversion path 122, e.g., provides diversion force 132 relative to media 16 when diverter 130 is in its active position. Flaps 134 and 136 are tied together, e.g., tied rigidly together at laterally outward portions 141 of flaps 134 and 136, and pivot in common about a diverter pivot axis 140. Thus, diverter 130 may be formed as or constructed to operate as one piece mounted in such manner to pivot about axis 140. Flap 136 includes a generally curved downward facing surface 137. When diverter 130 moves to its inactive position with media 16 therein, surface 137 further encourages bowing of media 16 in the feed direction 20 and in support of folding operation 10.

Thus, diverter 130 serves as a "media nozzle" selectively directing a leading portion of media 16 onto diversion path 122. In accordance with folding operation 10 as described above, diverter 130 moves to its inactive position subsequent to a leading edge 40 of a given one of media 16 embarking on path 122. As a result, trailing portions of such media 16 do not enter diversion path 122. Instead, trailing portions of media 16 pass diversion path 122 and thereby bend forward in accordance with folding operation 10.

Module 100 includes along diversion path 122 a selectively positionable stop 50. A selected location for stop 50 along diversion path 122 may be set by use of knobs 150. Knobs 150 mechanically couple to stop 50 and may be operated to release stop 50 for positioning and to lock stop 50 in a selected position. As may be appreciated, a broad variety of methods and devices may be employed for selectively positioning stop 50 along diversion path 122. While active components may be employed to position stop 50 in response to control circuitry, a low cost of manufacture and reliable operation results by simple mechanical coupling between knobs 150 and stop 50 to accomplish selective positioning of stop 50 along diversion path 122. In the particular form of module 100 illustrated herein, knobs 150 threadably couple to stop 50 and, when loosened, move as indicated at referenced numeral 152 and carry stop 50. In this manner, loosening knobs 150 allow positioning of stop 50 along diversion path 122. Once positioned, knobs 150 may be tightened to set a selected position for stop 50. Given standard media 16 dimensions, knobs 150 may be positioned relative to preset registration marks for accomplishing particular folding operations. More particularly, knobs 150 may be manipulated in relation to marks (not shown) associated with, for example, one-half folds, one-third folds, and other common folding selections for common media 16 dimensions.

Module 100 includes a pair of folding rollers 160 and 162 rotating in opposite directions and defining a nip 164. Nip 164 serves dual purposes. Media 16 reaching nip 164 are propelled onward in feed direction 20. In this respect, nip 164 serves a media handling or media transport function. If a given media 16 is appropriately "bowed" as it approaches nip 164, rollers 160 and 162 accomplish folding of media 16 at nip 164 as media 16 passes therethrough. In this respect, nip 164 serves a folding function. Rollers 160 accept media 16 moving therethrough with or without a fold. Folding rollers 160 and 162 can mount on rods 161 and 163, respectively. Driving one or both of rods 161 and 163 into suitable rotation accomplishes media 16 engagement and propulsion, and at times folding, at folding rollers 160 and 162 as described above. As may be appreciated, the material and surface texture as well as speed of rotation for rollers 160 and 162 can be suitable for accomplishing media 16 engagement, folding, and propulsion as described herein.

Module 100 as illustrated in FIGS. 5 and 6 does not include illustration of a particular media transport mechanism moving media 16 onto diversion path 122 and/or into nip 164. As may be appreciated, module 100 optionally can include a motor-driven feed and pinch roller arrangement at inlet 102 (not shown). As will be discussed more fully hereafter, however, an upstream printing mechanism and/or other modules 100 may be employed to propel or urge media 16 into a module 100, e.g., suitably apply force 118 to media 16. In this respect, media transport urges or pushes media into a folding operation. For example, an upstream module 100 may be used to propel media 16 sufficient distance into a downstream module 100 to engage the folding rollers 160 and 162 of the downstream folding module. In this regard, rollers 160 and 162 of an upstream module 100 can serve as a media transport mechanism relative to a downstream module 100. Thus, modules 100 may be arranged serially in the feed direction 20 for selectively executing consecutive folding operations 10 including, for example, multiple folds 82 in a given one of media 16.

While active components and control circuitry may be used in certain embodiments of a module 100 to direct operation of diverter 130, cost of manufacturing and cost of operation efficiencies may be had by suitably maintaining diverter 130 in its active position such as by a biasing force 139. By selecting an appropriate magnitude of biasing force 139, e.g., by gravitational or spring force, diverter 130 can successfully divert leading portions of media 16 onto path 122 and thereafter give-way to allow trailing portions of media 16 to pass thereby.

Thus, diverter 130 operation can be active, e.g., by mechanical or electromechanical devices, e.g., servo-devices for selectively positioning diverter 130. Diverter 130 operation as described may be accomplished, however, by applying an appropriate biasing force 139 without need for active controls, e.g., without need for active manipulation of diverter 130. Biasing force 139 may be employed to normally maintain diverter 130 in its "active" position as illustrated. Such biasing force 139 can be sufficient to resist initially the impact of leading edge 40 such that diverter 130 sends media 16 onto diversion path 122. By suitably selecting the magnitude of such biasing force 139, continued movement of media 16 after engaging stop 50 bears pressure forward against diverter 130 and causes diverter 130 to give-way. In other words, force 118 as continued against media 16 overcomes biasing force 139 as applied to diverter 130. Further urging of media 16 forward in the feed direction 20 forms a buckle and fully overcomes the biasing force 139. As a result, diverter 130 moves from its active position to its inactive position allowing remaining portions of media 16 to pass thereby in support of folding operation 10.

A variety of devices and methods may be employed to maintain diverter 130 in its "active" position as illustrated in FIG. 5. One form of module 100, therefore, can include a biasing force 139 applied to pivot diverter 130 about axis 140 and maintain diverter 130 in its "active" position. Such biasing force 139 can include, but is not limited to, use of springs and/or weighted levers to establish a cantilever torque, torsional, magnetic, pneumatic, overcenter, air pressure, hydraulic cylinders, and the like. Furthermore, the weight of diverter 130 itself can be used when distributed appropriately relative to axis 140 to maintain diverter 130 in its active position with appropriate biasing force 139 as described above. In other words, the center of gravity for diverter 130 may be located appropriately to serve itself as a weighted lever providing biasing force 139. Use of simple passive control mechanisms, e.g., spring or gravity biasing force 139, simplifies operation and reduces cost of manufacture of module 100.

Biasing force 139 may be provided, therefore, by a variety of methods and apparatus. FIG. 6 illustrates use of a weighted lever 180 tied at one end to diverter 130 coincident with axis 140. Extending therefrom, lever 180 carries a weight 182. Gravity pulling weight 182 in a direction transverse to feed direction 20 creates biasing force 139 with diverter 130 in its active position. As media 16 strikes diverter 130, biasing force 139 is sufficient to divert media 16 onto path 122, but not sufficient to fully resist media 16 after media 16 hits stop 50. As a result, diverter 130 pivots clockwise, in the view of FIG. 5, and weighted lever 180 moves against the force of gravity and diverter 130 moves into its inactive position. Once media 16 passes, the force of gravity against weighted lever 180 brings diverter 130 back into its active position. As may be appreciated, the length of lever 180 and mass of weight 182 may be varied according to particular needs of a particular module 100 embodiment. Also, weight 182 can be replaced by coupling the distal end of lever 180 by way of spring (not shown) to an anchor point (not shown). Similar operation of diverter 130 results.

In the alternative, latch mechanisms can be employed to augment a lesser magnitude biasing force 139 in support of diverter 130 operation as described herein. A latch and release mechanism can, as an alternative device, aid in maintaining or holding diverter 130 in its active position sufficiently to divert media 16 along path 122. Such latch mechanism could be suitably designed to "give-way" by trigger mechanism or by an appropriate magnitude of force thereagainst by media 16 under influence of force 118, e.g., as propelled by an upstream media transport device.

As a result, a simpler, lower cost design is available. No control signals or powered elements, e.g., cams, solenoids, and motors, are used.

FIGS. 7-10 illustrate a folding station 200. Media 16 enters station 200 at an inlet slot 202 and exits station 200 at an outlet slot 204. Folding station 200 uses a module 100 therein and presents externally rods 161 and 163 carrying rollers 160 and 162, respectively. Thus, slot 202 of station 200 corresponds to slot 102 of module 100 and slot 204 of station 200 corresponds to slot 104 of module 100. Generally, rods 161 and 163 simply remain rotating in opposite directions and thereby provide an ongoing media folding and media transport function. In this regard, rods 161 and 163 may be coupled to an electric motor (not shown) maintained within station 200 or, as discussed more fully hereafter, receive motive force from a separate device such as a printing mechanism or a separate folding station 200 in series therewith.

Figure 7:
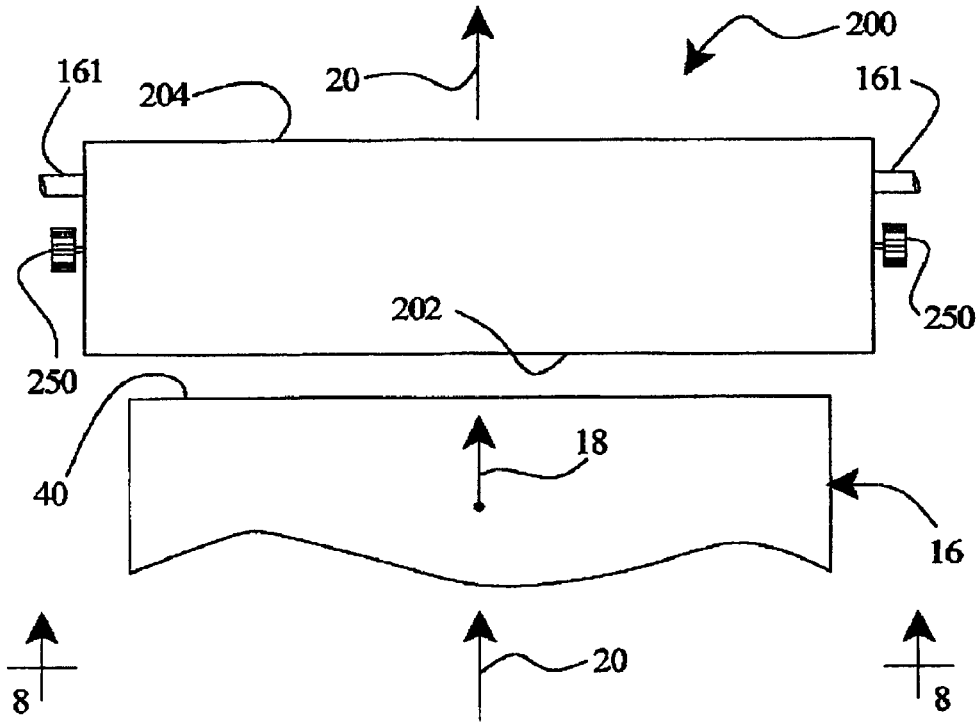
FIG. 7 illustrates the media folding module of FIGS. 5 and 6 serving as a folding station.
Figure 8:
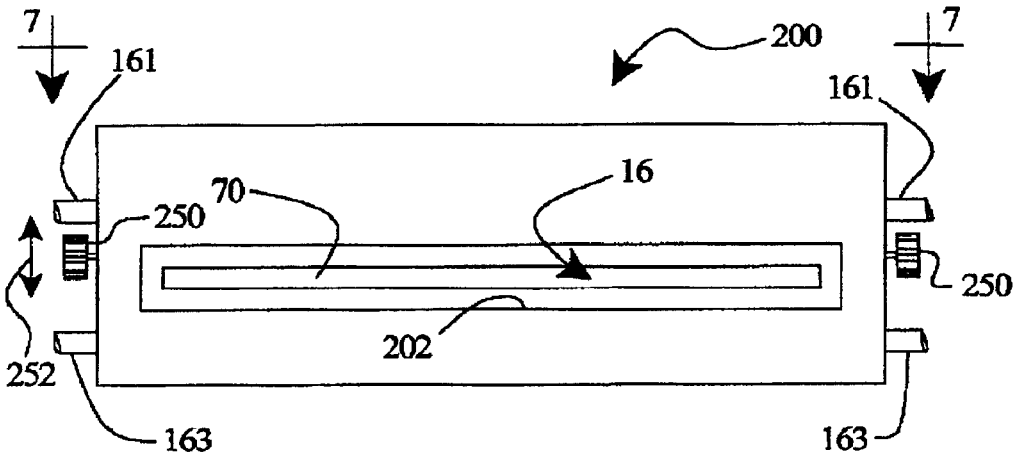
FIG. 8 illustrates the folding station of FIG. 7 as taken along lines 8—8 of FIG. 7.

Additional controls applicable to station 200 are locator knobs 250. As discussed above, locating stop 50 suitably along diversion path 122 affects the length of media 16 folded back onto itself as it passes out of station 200. Thus, locator knobs 250 may be moved through a given range as indicated at reference numeral 252 to position stop 50 through its selectable range of positions. Locator knobs 250 as illustrated in FIGS. 7 and 8 are user-adjustable devices mechanically coupled to stop 50 in such manner to accomplish selected positioning of stop 50 along diversion path 122. Preferably, knobs 250 have preset or indicated markers for positions providing, for example, commonly selected folding operations relative to common media 16 dimensions. For example, a first selectable location for knobs 250 applies a "one-third" fold for a common media 16 size. Another selectable location for knobs 250 provides a "one-half" fold for a common media 16 size. Thus, by providing indications for selectable locations for knobs 250, the user quickly selects a given amount of fold for a given media 16 size.

Figure 9:
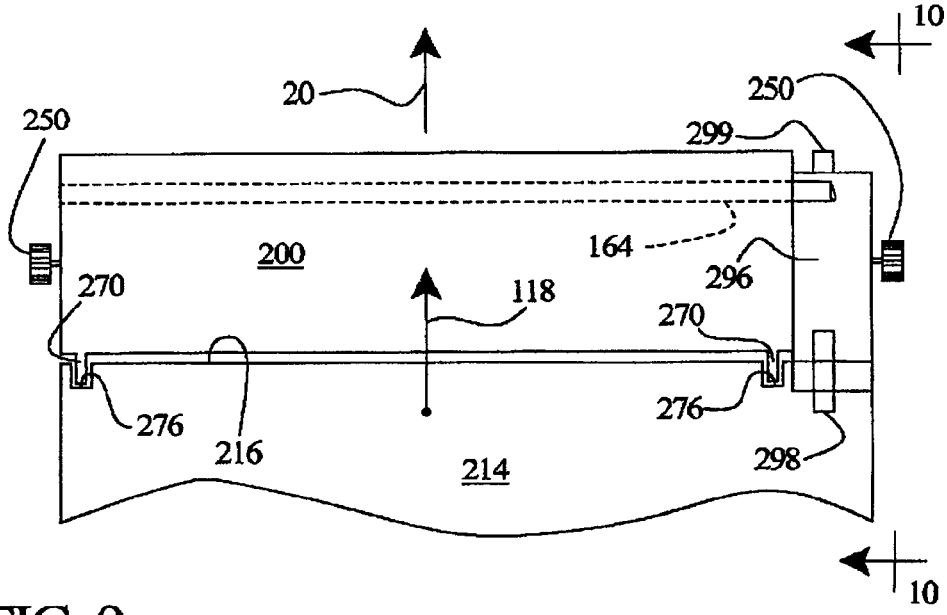
FIG. 9 illustrates the folding station of FIGS. 7 and 8 as coupled to a printing mechanism to receive media and motive force therefrom.
Figure 10:
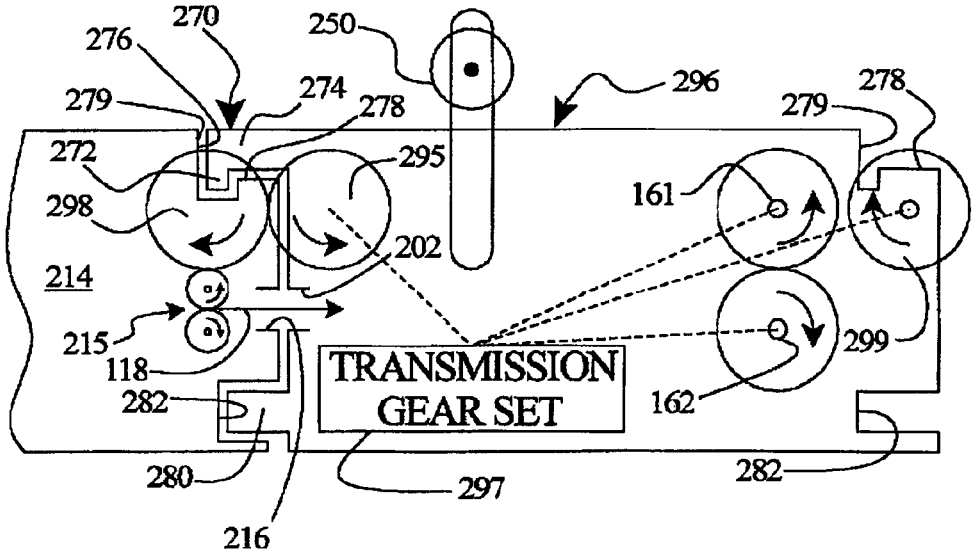
FIG. 10 illustrates a transmission portion of the combined printing mechanism and folding station of FIG. 9 as taken along lines 10—10 of FIG. 9.

FIGS. 9 and 10 illustrate use of station 200 as coupled to a printing mechanism 214. FIGS. 9 and 10 also illustrate the addition of a transmission 296 for transferring motive force from printing mechanism 214 to station 200 for coordinated and integrated production of print imaging and folding of media. Transmission 296 may be located and organized in a variety of ways. For example, transmission as illustrated is located on the right hand side of feed direction, but could be located on the left hand side of feed direction 20. The location of power take off gear 298 of printing mechanism 214 will provide basis for locating and organizing an appropriate transmission 296 site. Printing mechanism 214 can be a substantially general-purpose printing mechanism, e.g., an inkjet printing mechanism, having an ability to selectively propel media 16 out a rear slot 216 in the feed direction 20 and apply force 118 as described above. As shown schematically in FIG. 10, printing mechanism 214 includes media transport rollers 215 near rear slot 216 and applying force 118 to push media 16 into folding module 200. Rollers 215 could be part of an alternate media outlet feature of printing mechanism 214 selectively directing media out rear slot 216 following, for example, application of print imaging thereto, or could be in some embodiments a normal media outlet for printing mechanism 214.

Selectively directing media through a rear slot 216 of printing mechanism 214 can be accomplished by a variety of mechanisms. Duplex printing modules illustrated in U.S. Pat. Nos. 6,332,068; 6,293,716; 6,167,231; and U.S. Design Pat. No. 431,046, the respective disclosures thereof being incorporated fully herein by reference, show modules mountable to a printer in place of a "clean out" or "rear paper guide" structure. Such duplexing modules as mounted to a printing mechanism in the above-referenced US patents selectively divert media out a rear slot of the printing mechanism in support of duplex printing operations. It will be understood, however, that folding as coordinated and integrated with printing operations may be performed by taking media from other portions of a printing mechanism. For example, media may be taken for folding and introduced into folding modules as illustrated herein from the normal media exit of a printing mechanism. As applied to the illustrated embodiment herein, such methods and apparatus may be employed to direct media 16, following application of print imaging thereto, out a rear slot 216 of the printing mechanism 214. As discussed more fully hereafter, such media 216 may be propelled through one or more folding modules in support of folding operations as described herein. The final product, e.g., media 16 bearing print imaging and folded according to a selected set of folding operations exits the printing and folding system at a last one of such folding modules attached in series to printing mechanism 214.

The location of media transport mechanisms, e.g., rollers 215, within printing mechanism 214 relative to a nip 164 of station 200, i.e., a nip formed by rollers 160 and 162, allows media 16 to travel sufficient distance for engagement at nip 164. In other words, printing mechanism 214 supplies force 118 relative to media 16 exiting printing mechanism 214 sufficiently to maintain media 16 travel distance into nip 164 of station 200. As may be appreciated, however, contribution of force 118 may be provided in the alternative by feed rollers located within station 200. In such configuration, station 200 may be operated independently relative to a printing mechanism 214.

Figure 10A:
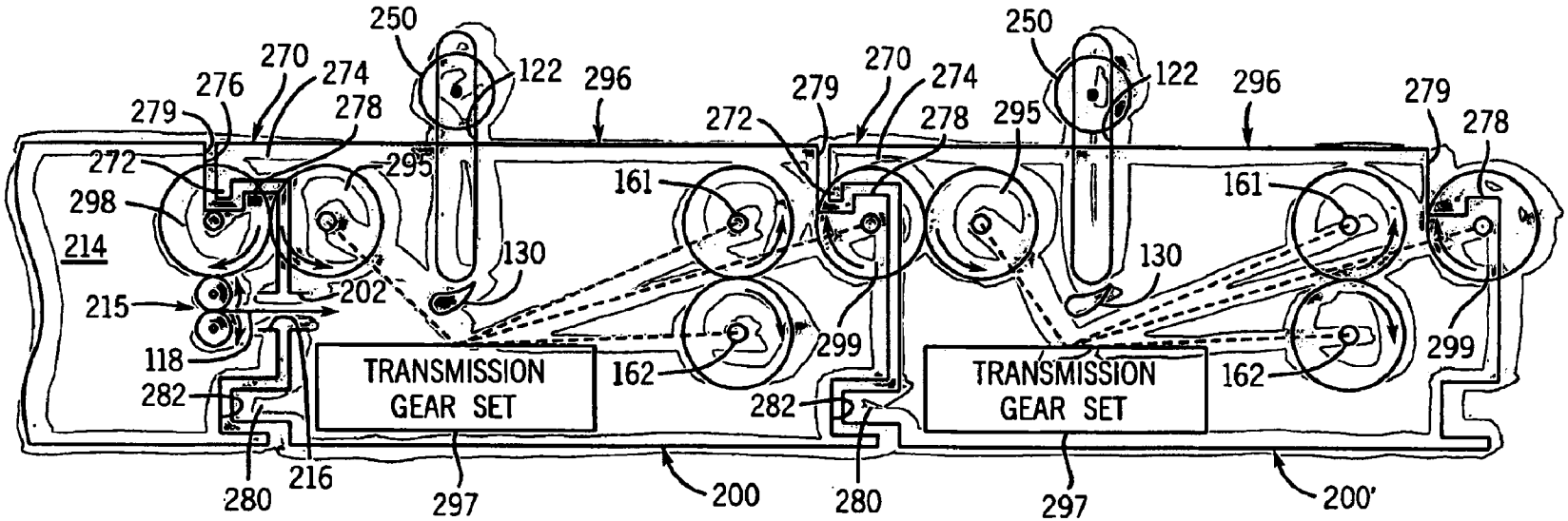
FIG. 10A schematically illustrates an additional folding station coupled to the printing mechanism and folding station of FIG. 10.

Transmission 296 mechanically couples a power take off gear 298 of printing mechanism 214 and at least one of rods 161 and 163 of station 200. In this manner, transmission 296 rotates rollers 160 and 162 of station 200. Transmission 296 further presents at a downstream portion thereof a power take off gear 299. When additional folding stations are mounted in series with station 200, motive force for operation thereof may be taken from gear 299 in fashion similar to that of station 200 deriving motive force from power take off gear 298 of printing mechanism 214. FIG. 10A illustrates an additional folding station 200' mounted in a series with station 200. Folding station 200' is identical to station 200.

The particular architecture of transmission 296 may vary according to a variety of particular implementations. As illustrated herein, therefore, transmission 296 includes an appropriate transmission gear set 297 for suitably operating transmission 298 as described herein. More particularly, transmission gear set 297 suitably couples power take off gear 298 and rods 161 and 162 for appropriate rotation of rollers 160 and 162, respectively. Similarly, transmission gear set 297 applies motive force, as taken from an upstream power take off gear 298, to its power take off gear 299.

To support attachment of station 200 to printing mechanism 214, printing mechanism 214 includes a mounting site compatible with a mounting structure of station 200. A variety of mounting arrangements may be employed to selectively mount a folding module to a printing mechanism as described herein. The particular structures illustrated herein are by example only and do not limit implementation of folding operations as described herein. For example, station 200 includes a pair of ears 270, including a horizontal section 272 and vertical section 274. Printing mechanism 214 includes a pair of compatible slots 276 including a horizontal portion 278 and vertical portion 279. Module 200 also includes a pair of projections 280 compatible with a pair of slots 282 of printing mechanism 214. By inserting ears 270 into slots 276 and projections 280 into slots 282, a user attaches station 200 to printing mechanism 214. As may be appreciated, such mounting arrangement should include sufficient attachment and architecture to securely engage power take off gear 298 of printing mechanism 214 with transmission 296. In this manner, motive force taken from printing mechanism 214 applies to transmission 298 in support of station 200 operations as described herein.

Folding operation 10 and the illustrated example of one mechanism, e.g., module 100 and station 200, for implementing folding operation 10 performs "lateral" folding. For example, the fold produced by operation 10 and module 100 lies transverse to feed direction 20.

Another folding operation often found useful is a "longitudinal fold", e.g., where a fold or crease forms in parallel relation to feed direction 20.

FIGS. 11–17 illustrate a folding station 400 executing a longitudinal fold, i.e., a fold parallel to a feed direction 20. Module 400 includes an intake slot 402 and an outlet slot 404. Inlet slot 402 lies in orthogonal relation to outlet slot 404. As discussed more fully hereafter, media 16 enters slot 402 and undergoes transition in orientation by folding thereof as it exits module 400 at outlet slot 404. A trough or well 412 couples slots 402 and 404. At slot 402, well 412 is coplanar with the floor of slot 402. Well 412 couples a mid-point of slot 402 with the bottom of slot 404. In other words, well 412 is coincident with the floor of slot 402 and forms progressively as a gradual "groove" as side panels 413 and 415 rise up from well 412 in transition from horizontal, in the view of FIGS. 11–13, to vertical, in the view of FIGS. 11–13. More particularly, well 412 lies generally in horizontal orientation, in the view of FIG. 11, with side panels 413 and 415 in edge-to-edge relation therewith and extending upward, in the view of FIG. 11, therefrom. Panels 413 and 415 provide, therefore, transition from the orientation of slot 402 to the orientation of slot 404.

Figure 11:
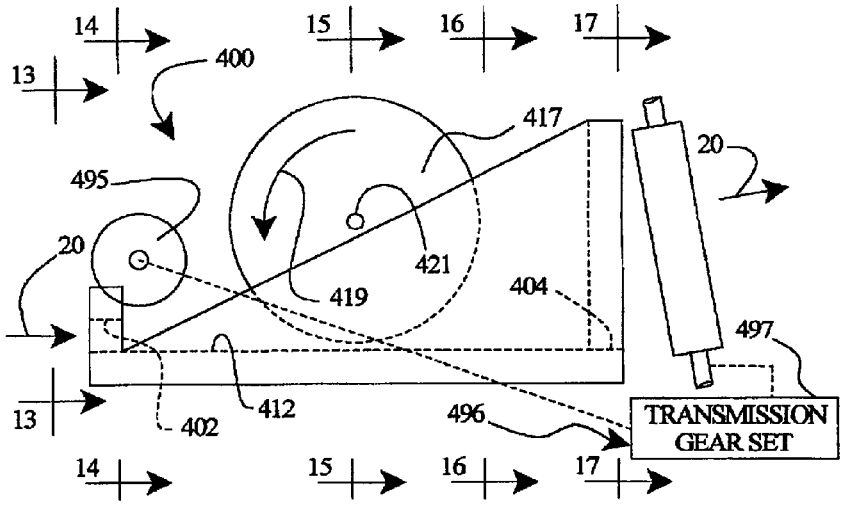
FIG. 11 is a side elevational view of a second media folding module.

FIGS. 14-17 show the surface geometry of side panels 413 and 415 progressively along feed direction 20 and as taken along lines 14—14, 15—15, 16—16, and 17—7 of FIG. 11. Media 20 moving along feed direction 20 encounters panels 413 and 415 in progressively more upright surface orientation. As a result, media 16 undergoes transition from planar as it enters slot 402 to a folded condition as it exits slot 404 with a first portion in face-to-face relation with a second portion.

Intermediate slot 402 and slot 404, a free-rotating creasing wheel 417 lies adjacent therefrom 412 and rotates freely, as indicated at reference numeral 419, on a rod 421. In the alternative, a fixed wire or thin metal guide positioned directly above well 412 may be employed as a substitute for wheel 417. In either case, wheel 417, or in the alternative a fixed wire or thin metal guide directly above and parallel to well 412, holds the center of media 16 down as the side portions of media 16 fold up into vertical, in the view of FIGS. 11–13, orientation. Thus, wheel 417, or in the alternative a fixed wire or thin metal guide, holds media 16 along a portion thereof where a fold is to occur. Wheel 417, or in the alternative a fixed wire or thin metal guide, does not actually fold or crease media 16. Folding, as discussed hereafter, occurs downstream from outlet 404 at folding rollers 460 and 462. Media 16 (not shown) enters slot 402 and moves under wheel 417. Wheel 417 maintains media 16 against well 412 as side panels 413 and 415 lift upward and into face-to-face relation the side portions of media 16. As the leading edge of media 16 approaches slot 404, it achieves a more upright orientation and exits slot 404 in substantially folded condition.

Folding rollers 460 and 462 supported by rods 461 and 463, respectively, present a nip 464 therebetween. Nip 464 lies generally parallel to leading edge 40 as it accepts media 16 from slot 404. In other words, as media 16 exits slot 404, it enters the nip 464 of rollers 460 and 462 and is pressed together firmly thereat. As a result, media 16 feeds through station 400 and folds longitudinally. As may be appreciated, station 400 may include one or more electric motors coupled to rollers 460 and 462 to accomplish rotation thereof. In the alternative, however, station 400 may be equipped with a transmission 496 taking motive force from an upstream device, e.g., an upstream folding module, for application to rollers 460 and 462. For example, transmission 496 includes a power collection gear 495 and transmission gear set 497 coupling gear 495 to rollers 460 and 462. An upstream device, e.g., a folding station 300 at its power takeoff gear 399, provides motive force driving power collection gear 495 and, therefore, rollers 460 and 462.

Rollers 460 and 462 may be suitably oriented relative to the expected orientation of media 16 as it exits station 400. More particularly, rollers 460 and 462 may be tilted back toward the direction of media approach, e.g., opposite feed direction 20, to account for path length differences between the center of media 16 as traveling in well 412 and the outer portions of leading edge 40 as traveling against and along panels 413 and 415. This may be visualized by placing a longitudinal fold partially down a sheet of paper from the leading edge and holding the trailing edge flat on a horizontal surface. The leading edge, now folded in U-shape, lies at an angle and preferably substantially parallel to rollers 460 and 462. As a result, feed direction 20 downstream from rollers 460 and 462 changes in its directional components, e.g., is not directed entirely in the horizontal direction (in the view of FIG. 11) as compared to upstream portions of feed direction 20.

Figure 12:
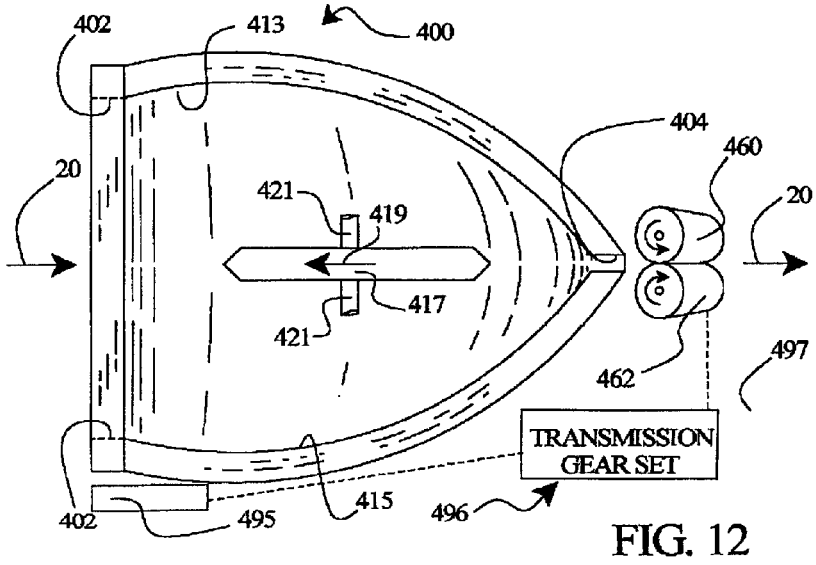
FIG. 12 is a top view of the media folding module of FIG. 11 as taken along lines 12—12 of FIG. 11.
Figure 13:
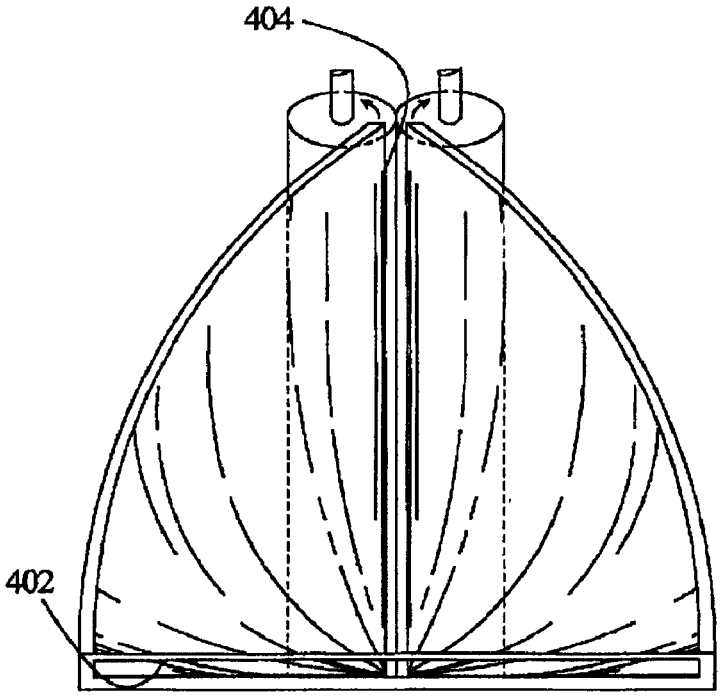
FIG. 13 is an end view of the media folding module of FIGS. 11 and 12 as taken along lines 13—13 of FIG. 11.
Figure 14:
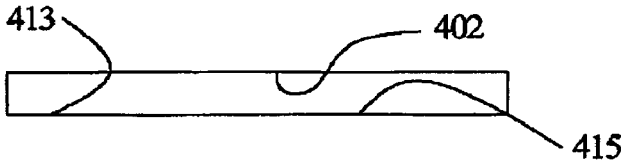
FIGS. 14–17 illustrate media guide surface geometry of the media folding module of FIGS. 11–13 as taken along lines 14—14, 15—15, 16—16, and 17—17 respectively, of FIG.
Figure 15:
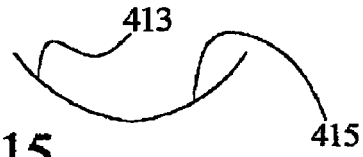
Figure 16:
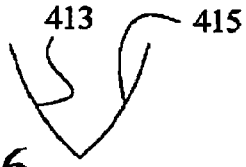
Figure 17:
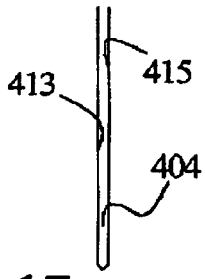

Various folding and printing systems are possible under the illustrated embodiments. A single lateral folding station 200 as illustrated in FIGS. 5 and 6. When only one fold is needed a station 200 provides folding at a selected proportion of media 16. FIGS. 11–13 illustrate a single-longitudinal fold station 400.

Figure 18:
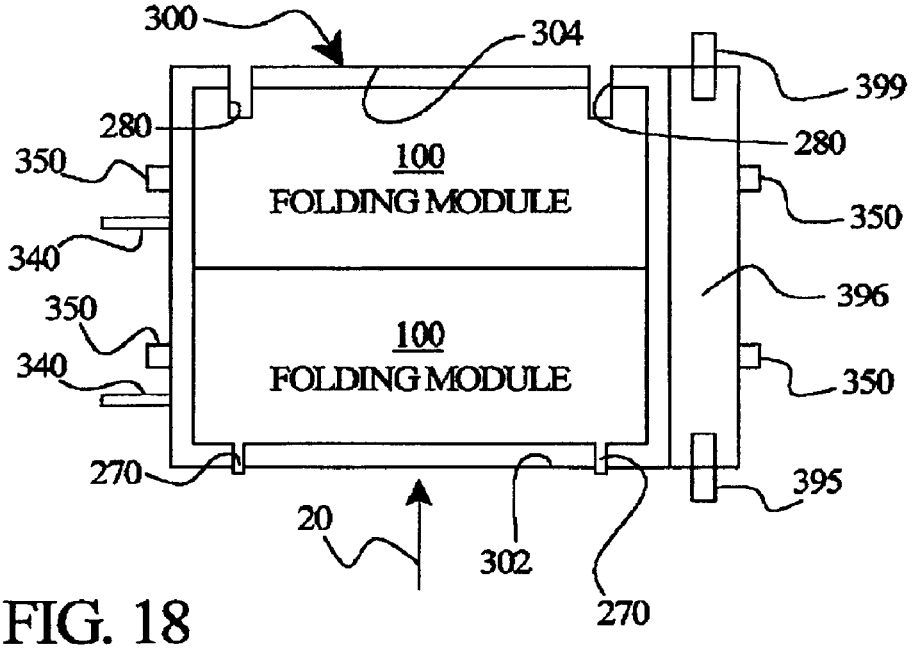
FIG. 18 illustrates a folding station including a pair of the modules illustrated in FIGS. 5 and 6 operating in series.

FIG. 18 illustrates a double-lateral fold station 300 operating as a pair of modules 100 in series. As may be appreciated, station 300 executes single lateral folds by deactivating one of modules 100. Activating both of modules 100 within station 300 accomplishes double-lateral folding. In other words, accomplishes application of two folds 82 to a given one of media 16 passing therethrough. A module 100 can be deactivated by moving diverter 130 to its inactive position and locking diverter 130 thereat. For example, a user-operated latch mechanism 340 may be employed to lock each diverter 130 in its inactive position as described more fully hereafter. Station 300 includes a first pair of knobs 350 for selectively positioning a first one of stops 50 in a first one of folding modules 100 and a second pair of knobs 350 for the second one of folding modules 100. In this manner, each of modules 100 within station 300 may be adjusted with respect to a stop 50 therein to control the amount of fold applied to media 16 passing therethrough. Station 300 can be fitted with suitable mounting structures and mounting sites as described above with respect to station 200. More particularly, station 300 includes ears 270 at an upstream portion thereof and slots 280 at a downstream portion thereof. In this manner, station 300 mounts, for example, to a printing mechanism 214 as described above with respect to station 200. By providing slots 280 at a downstream portion of station 300, additional folding modules equipped with ears 270 may be mounted thereat. A transmission 396 of station 300 collects motive force from an upstream device, e.g., a printing mechanism 214, at a power collection gear 395. Within transmission 396, motive force is distributed to operate rollers 160 and 162 of each folding module 100 as well as apply motive force to a power take off gear 399. Power take off gear 399 may be accessed by downstream folding modules to distribute motive force therealong.

By making compatible media transport hand off between various folding modules, selected folding operations operate in modular fashion by selectively coupling together folding modules. Similarly, equipping folding modules as described herein with compatible transmissions passes motive force along a series of folding modules and thereby avoids need for use of motors or active devices within each of the folding modules to accomplish operation thereof.

Figure 19:
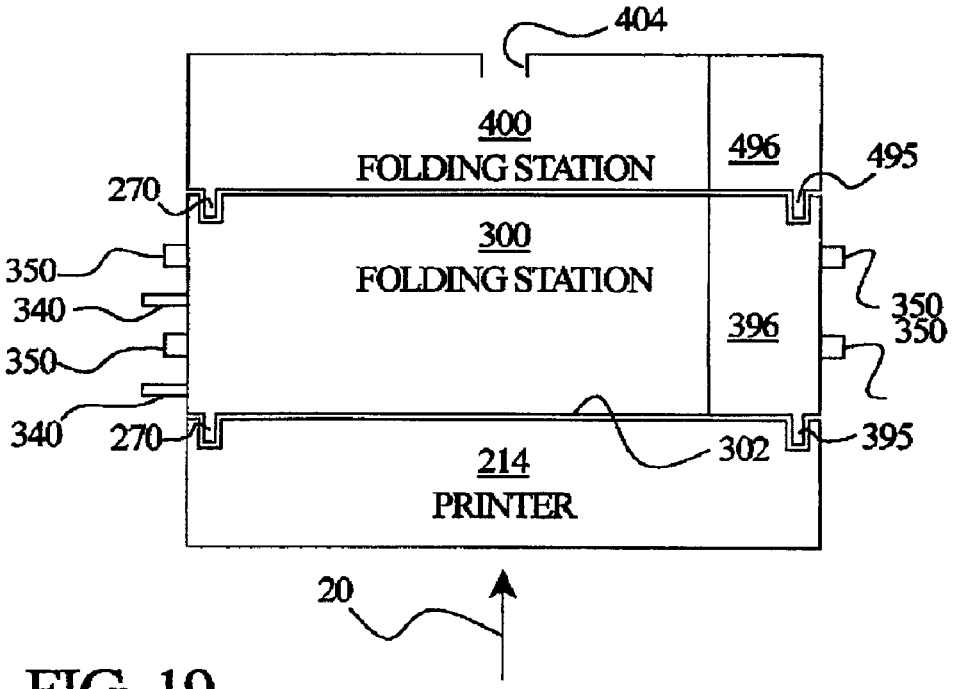
FIG. 19 illustrates a printing system making use of selected folding modules to accomplish selected folding operations.

FIG. 19 illustrates the modularity of folding operations as possible by use of various folding modules illustrated herein. Modular construction of folding stations supports selected organization of folding stations in series and as attached to a printer 214. Thus, an upstream portion of each folding station includes a mounting structure, e.g., ears 270, compatible with a mount site, e.g., slots 280, of a downstream side of the preceding component. FIG. 19 illustrates one such organization of printer and folding stations. It will be understood, however, that a variety of such components may be organized in a variety of ways to accomplish selected printing and folding operations. More particularly, a variety of mounting structures and mounting sites may be used to construct in series selected folding modules as described herein. The particular mounting arrangements shown, e.g., ears 270 and slots 280, are provided only as an example of such mounting of folding modules in modular fashion. In FIG. 19, a printer 214 receives at a rear mounting site thereof a folding station 300. Printer 214 couples to transmission 396 of station 300 to apply motive force thereto. Station 300 in turn provides a mounting site at which folding station 400 mounts. Transmission 396 of station 300 provides a power take off gear 399 driving transmission 496 of station 400. In this manner, motive force originating at printer 214 transfers through station 300 and to station 400 in support of folding operations throughout.

By making compatible the mounting sites and corresponding mounting structure for printer 214 and various folding modules, modules can be arranged in any selected order.

As discussed above, folding module 100 preferably operates without any active controls applied to diverter 130. In the alternative, a simple latch mechanism may be employed to hold diverter 130 in its active position and respond to presentation of leading edge 40 at stop 50 to release diverter 130 from its active position.

Figure 20:
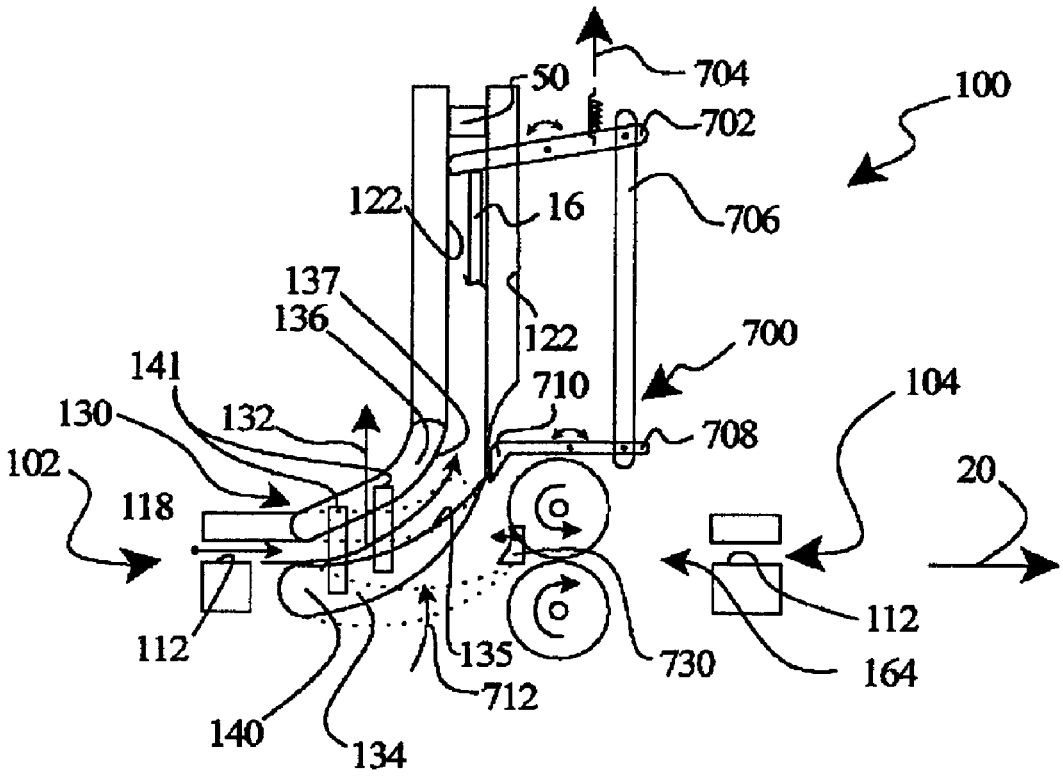
FIG. 20 illustrates an alternative form of folding module including a latch mechanism.

FIG. 20 illustrates and alternative form of module 100. Latch 700 is "set" by a small biasing force 712 bringing diverter 130 into its active position. Latch 700 thereafter maintains significantly greater resistance to media force bearing against diverter 130 and thereby diverts successfully leading edge 40 onto diversion path 122. Latch 700 can give-way at a given (or selected) magnitude of force against diverter 130. When the force of media 16 against diverter 130 reaches this magnitude, latch mechanism 700 gives-way and media 16 forces diverter 130 into its inactive position. Alternatively, and as illustrated in the embodiment of FIG. 20, latch 700 can be released by a trigger lever 702 positioned near stop 50.

Lever 702 pivotally mounts at a mid-point thereof and includes a first inner end positioned near stop 50 and a second outer end receiving an upward spring-biasing force 704. The outer end of lever 702 connects by a link 706 to a second lever 708. The second lever 708 pivotally mounts at a mid-point thereof and has at its inner end a latch 710. The second lever 708 couples at its outer end to the link 706. When diverter 130 moves under its biasing force 712, it engages the latch 710 of lever 708 and is held thereat, i.e., positively held in its active position. When media 16 travels upward along diversion path 122 and engages the inner end of lever 702, lever 702 pivots against its biasing force 704 and drives downward the outer end of lever 708 thereby releasing latch 710 and freeing diverter 130. At this point, i.e., with leading edge 40 of media 16 having just encountered stop 50, continued movement of media 16 against the now-released diverter 130 moves diverter 130 out of its active position and against its biasing force 712. As a result, trailing portions of media 16 bow and enter the nip 164 of rollers 160 and 162.

A second latch 730 may be positioned outside, i.e., beyond, normal diverter 130 travel in response to passage of media 16 thereby. A user wishing to disable diverter 130, i.e., conduct no folding thereat, moves manually diverter 130 past its normal inactive position, i.e., beyond where it normally travels in response to media 16 passing thereby, and engages latch 730. In this manner, a given folding module 100 may be taken out of operation until a user releases latch 730 and allows diverter 130 to return under biasing force 712 to its active position. Latch 730 may be suitably mechanically coupled to control 340 as illustrated in FIGS. 18 and 19 to selectively deactivate a given folding module 100. In other words, one or both of modules 100 within station 200 may be deactivated by appropriate manipulation of latch controls 340. In this manner, a user can apply no lateral folding, single lateral folding, or double lateral folding by suitably deactivating selected one or ones of folding modules 100 within station 300. A similar control mechanism may be applied to station 200 as illustrated herein above.

It will be appreciated that the present invention is not restricted to the particular embodiments that have been described and illustrated, and that variations may be made therein without departing from the scope of the invention as found in the appended claims and equivalents thereof.

What is claimed is:

1. A method of media folding comprising:

propelling media along a first path;

biasing a diverter to an active condition with a bias force;

diverting a leading edge of media along a second path by the diverter in the active condition;

moving the media against the diverter to overcome the bias force and to move the diverter to an inactive condition while the leading edge is along the second path;

blocking said leading edge along said second path;

buckling said media at an intermediate portion of said media;

propelling the intermediate portion past the diverter while the diverter is in the inactive condition to engaging surfaces; and engaging said intermediate portion with the engaging surfaces to fold said media.

2. A method according to claim 1 wherein said propelling includes propelling said media from a printing mechanism.

3. A method according to claim 1 wherein said blocking said leading edge occurs at a selected location along said second path.

4. A method according to claim 1 wherein said buckling occurs by further propelling said media at a trailing portion thereof along said first path and subsequent to blocking said leading edge.

5. A method according to claim 1 further comprising at least one iteration of the method of claim 1 relative to a given one of said media and forming a corresponding at least one additional fold relative to said given one of said media.

6. A method according to claim 1 wherein said engaging said intermediate portion includes passing said media between folding rollers.

7. A method according to claim 6 wherein said folding rollers rotate by application of motive force taken from a printing mechanism.

8. A method according to claim 1 wherein said method includes mounting a folding module at a mounting site of a printing mechanism, said folding module accomplishing said diverting, said blocking, said buckling, and said engaging.

9. A method according to claim 8 wherein said module receives motive force from said printing mechanism in accomplishing at least one of said diverting, blocking, buckling, and engaging.

10. A method according to claim 1 wherein said method applies to sheet-form media and said propelling comprises urging media into at least one of said diverting, blocking, bucking, and engaging.

11. A method according to claim 1 wherein said first path corresponds to a feed direction and said second path corresponds to a diversion path.

12. A method of producing folded printed material comprising:

applying by printing mechanism print imaging to said material;

feeding said material from said printing mechanism into a first folding module attached thereto;

diverting a leading portion of said material along a first diversion path while continuing propulsion of said material into said folding module by engaging the material with a first diverter surface while the first diverter surface is biased to a first position by a biasing force;

ceasing said diversion and allowing urging a trailing portion of said material against the first diverter surface to overcome the biasing force and to move to pass said diversion path by moving the diverter surface to a second position while the leading portion is along the diversion path; and propelling a bowed portion of the material past the first diverter surface to a folding device while the first diverter surface is in the second position; engaging the bowed portion of said material at the folding device and folding said material.

13. A method according to claim 12 further comprising use of said folding device to further propel said material into a second folding module removably coupled to the first module as an operable unit such that the first module is operable independent of the second module when the second module is removed, the second module including a second diverter surface, a second diversion path and folding rollers, whereas a leading portion of said material diverts onto said second diversion path while continuing propulsion of said material into said second folding module and blocking the leading portion while the leading portion is along the second diversion path.

14. A method according to claim 12 wherein said method includes said folding device further propelling said material into a second folding module and including guiding of said material along guide surfaces from an input slot of said second folding module to an output slot of said second folding module, said guiding surfaces making transition from a coplanar relation with said input slot to a coplanar relation with said output slot.

15. A method according to claim 12 wherein said ceasing said diversion occurs in response to said feeding said material from said printing mechanism.

16. A method of media folding comprising:

propelling media along a first path;

diverting a leading edge of media to a second path with a diverting surface, said diverting executing selectively, an active condition of said diverting including diverting said leading edge along said second path and an inactive condition of said diverting allowing media to pass thereby, a transition from said active condition of said diverting to said inactive condition of said diverting occurring in response to said propelling media applying a force to overcome a bias force being applied to the diverting surface;

blocking said leading edge along said second path;

buckling said media at an intermediate portion of said media; and engaging said intermediate portion to fold said media.

17. A method according to claim 16 wherein said propelling includes propelling said media from a printing mechanism.

18. A method according to claim 16 wherein said blocking said leading edge occurs at a selected location along said second path.

19. A method according to claim 16 wherein said buckling occurs by further propelling said media at a trailing portion thereof along said first path and subsequent to blocking said leading edge.

20. A method according to claim 16 further comprising at least one iteration of the method of claim 1 relative to a given one of said media and forming a corresponding at least one additional fold relative to said given one of said media.

21. A method according to claim 16 wherein said engaging said intermediate portion includes passing said media between folding rollers.

22. A method according to claim 21 wherein said folding rollers rotate by application of motive force taken from a printing mechanism.

23. A method according to claim 16 wherein said method includes mounting a folding module at a mounting site of a printing mechanism, said folding module accomplishing said diverting, said blocking, said buckling, and said engaging.

24. A method according to claim 23 wherein said module receives motive force from said printing mechanism in accomplishing at least one of said diverting, blocking, buckling, and engaging.

25. A method according to claim 16 therein said method applies to sheet-form media and said propelling comprises urging media into at least one of said diverting, blocking, bucking, and engaging.

26. A method according to claim 16 wherein said first path corresponds to a feed direction and said second path corresponds to a diversion path.

* * * * *

UNITED STATES PATENT AND TRADEMARK OFFICE

CERTIFICATE OF CORRECTION

PATENT NO. : 6,899,665 B2
APPLICATION NO. : 10/131314
DATED : May 31, 2005
INVENTOR(S) : Matt G. Driggers It is certified that error appears in the above-identified patent and that said Letters Patent is hereby corrected as shown below:

Column 2, line 24, after "FIG." insert --11.--

Column 9, line 53, delete "17-7" and insert therefor --17-17--

Claim 25, Column 14, line 58, delete "therein" and insert therefor --wherein--

Signed and Sealed this

Twenty-seventh Day of May, 2008

Jon W. Dudas

JON W. DUDAS
*Director of the United States Patent and Trademark Office*